US006296521B1

(12) United States Patent
Chang et al.

(10) Patent No.: US 6,296,521 B1
(45) Date of Patent: Oct. 2, 2001

(54) ELECTRICAL CONNECTOR WITH POWER CONTACTS POSITIONED AT LATERAL ENDS WITHOUT INCREASING DIMENSION THEREOF

(75) Inventors: Jen Jou Chang, Yung-Ho; Yung Ming Yu; Yu-Lung Shih, both of Tu-Chen, all of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/770,869

(22) Filed: Jan. 26, 2001

(51) Int. Cl.[7] ..... H01R 13/648
(52) U.S. Cl. ..... 439/607; 439/79
(58) Field of Search ..... 439/607–610, 439/79, 541.5

(56) References Cited

U.S. PATENT DOCUMENTS 5,797,770 * 8/1998 David et al. ..... 439/607
6,027,375 * 2/2000 Wu ..... 439/607
6,086,421 * 7/2000 Wu et al. ..... 439/607
6,099,351 * 8/2000 Wu ..... 439/607

* cited by examiner

*Primary Examiner*—Hien Vu
(74) *Attorney, Agent, or Firm*—Wei Te Chung

(57) ABSTRACT

An electrical connector assembly includes a plug connector and a receptacle connector adapted to mate each other. The receptacle connector includes an insulative housing enclosed within a shell. The housing includes a main body with a tongue extending forwardly therefrom. A plurality of signal contacts received within the housing. A pair of power contacts are respectively disposed by two sides of the signal contacts in the housing. The plug connector includes the similar basic structures as the receptacle connector. The pair of power contacts of both the receptacle connector and the plug connector are delicately configured in the limited space in the corresponding connector housing to meet the required characters/qualities while without any interference in either mutually mating or self-assembling.

5 Claims, 15 Drawing Sheets

ELECTRICAL CONNECTOR WITH POWER CONTACTS POSITIONED AT LATERAL ENDS WITHOUT INCREASING DIMENSION THEREOF

BACKGROUND OF THE INVENTION

1. Filed of the Invention

The invention relates to an electrical connector, and particularly to the Universal Serial Bus connector assembly with relatively great current power transmission function while without increasing the original dimension or space thereof.

2. The Related Art

As notebook computers are made smaller and smaller, available space in each notebook computer for receiving necessary peripheral devices, such as hard disc driver (HDD) or compact disk read-only-memory (CD ROM), becomes limited. Therefore, these peripheral devices are being made to operate outside the notebook computer, so that, when in use they are connected to the notebook computer by a cable connector assembly. Many of the notebook and peripheral device cable interfaces use universal serial bus connectors (as shown in U.S. Pat. Nos. 6,053,773 and 6,086,420), and a separate power jack is used for supplying power from the notebook computer to each peripheral device.

The present usage has the disadvantage that it needs two different types of connectors (i.e., USB and power jack) to operate each peripheral device, which is not only costly, but also uses more space to accommodate the connectors. Furthermore, a user has to plug in cables to both a USB connector and a powerjack and this is inconvenient.

Therefore, a USB connector with a power transmission function is needed to overcome the disadvantages of the conventional art. U.S. Pat. No. 6,027,375 discloses one approach with a two-story(port) USB connector of which one port is used for signals and the other is used for power. Anyhow, although this design saves the lateral space while still occupies too much vertical space. Recently, other approaches have been made by the assignee to provide a single USB connector with a larger lateral dimension thereof by which one larger power contact is installed within the enlarged connector housing for power transmission function thereof. Anyhow, the users and/or the computer manufacturers want a connector with the power transmission function while still maintaining the original size so as not to complicate the PCB layout design for the computer manufacturer. Additionally, using the same dimensioned connector also allows the user to use the regular mating connector, if no power plus signal mating connector is available, without interference while still performing the regular signal transmission function.

Therefore, the copending applications with U.S. Ser. No. 09/752,421 and U.S. Ser. No. 9/752,631 both filed Dec. 22, 2001 having the same assigned with the invention, disclose the newest approach which installs a power contact within the USB connector housing having the same dimension as the regular/original USB connector. Anyhow, the contact portions of the power contacts of the above two applications are generally located around rear portions of the connector housings thereof. It may result in reliability issue if the mating connector is not completely mated therewith. Additionally, some circuit designers like to have the power/ground first mated/function before the signals.

Therefore, a reliable USB connector assembly with the power transmission function thereof while with the similar dimensions of the original one is desired.

SUMMARY OF THE INVENTION

According to an aspect of the invention, an electrical connector assembly includes a plug connector and a receptacle connector adapted to mate each other.

The receptacle connector includes an insulative housing enclosed within a shell. The housing includes a main body with a tongue extending forwardly therefrom. A plurality of signal contacts received within the housing. A pair of power contacts are respectively disposed by two sides of the signal contacts in the housing.

The plug connector includes an insulative housing enclosed within a shell. The housing includes a main body with a contact platform and a solder platform respectively forwardly and rearwardly extending therefrom. A plurality of signal contacts received within the housing. A pair of power contacts are respectively disposed by two sides of the signal contacts in the housing.

When the receptacle connector and the plug connector are mated with each other, both the signal contacts and the power contacts of the receptacle connector and those of the plug connector are engaged with each other in a parallel relationship.

DETAILED DESCRIPTION OF THE PREFERRED EMBODIMENTS

Figure 1:
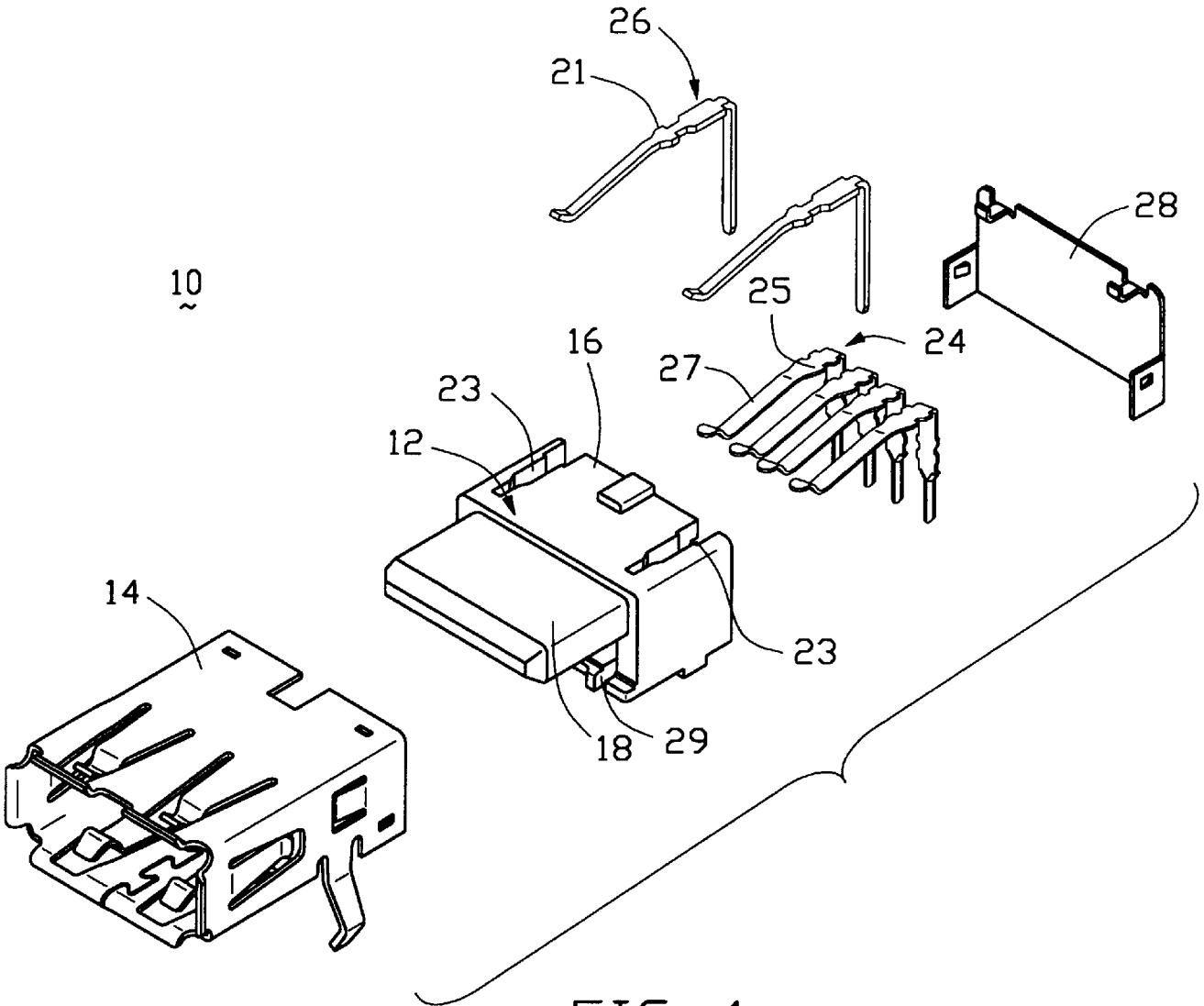
FIG. 1 is an exploded perspective view of a receptacle connector according to the invention.
Figure 2:
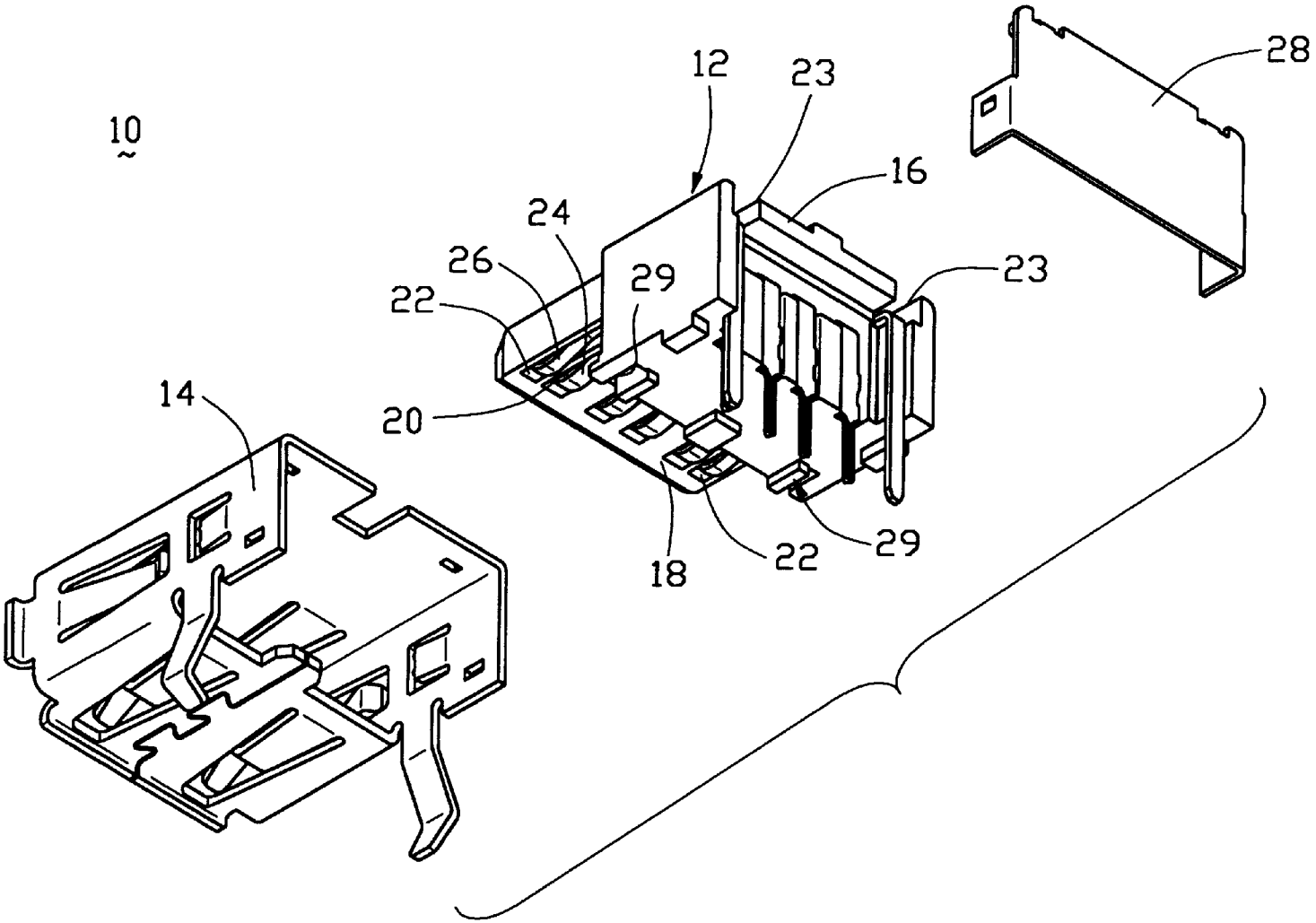
FIGS. 2–4 are exploded perspective views of the partially assembled receptacle connector of FIG. 1 from different angles.
Figure 3:
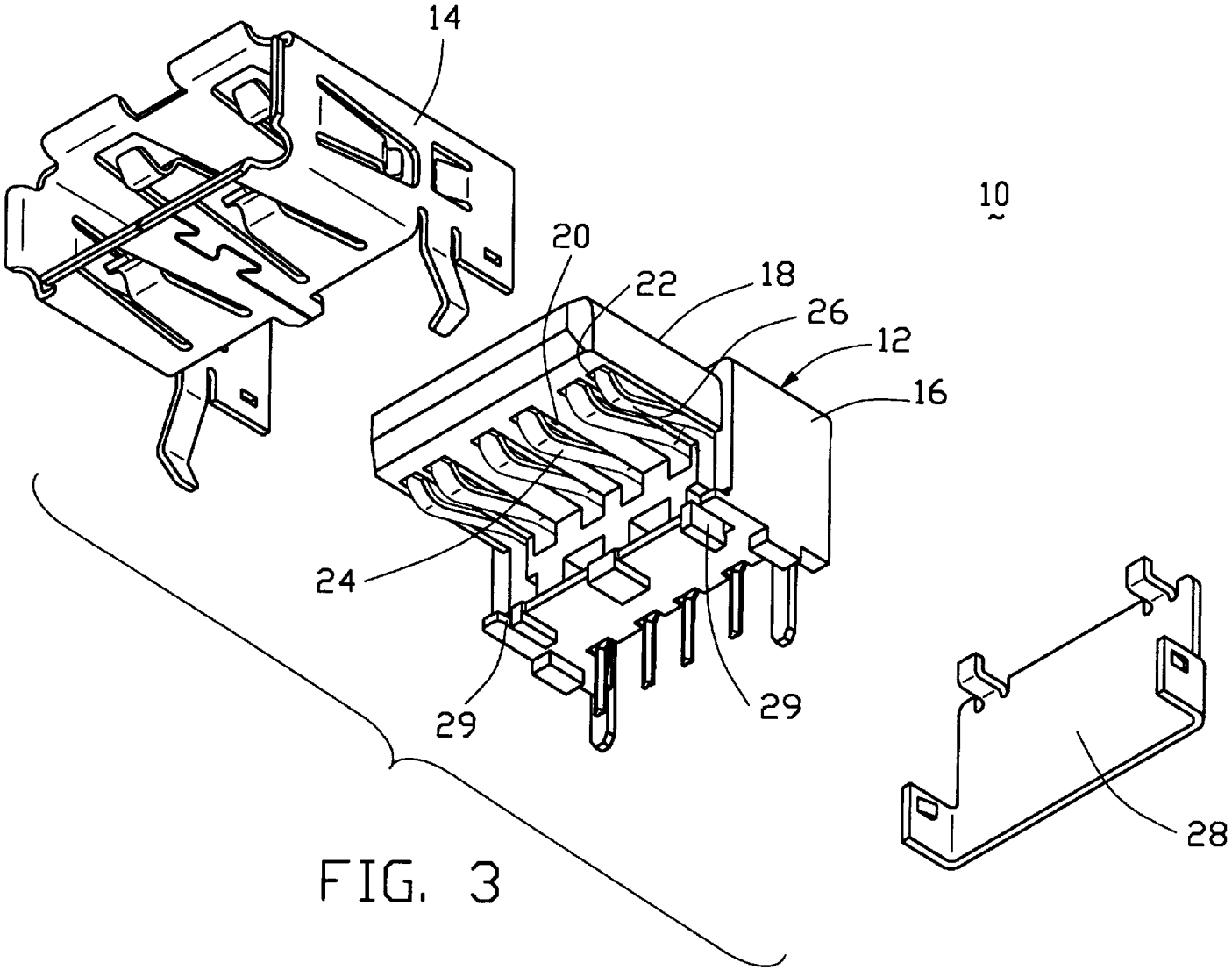
Figure 4:
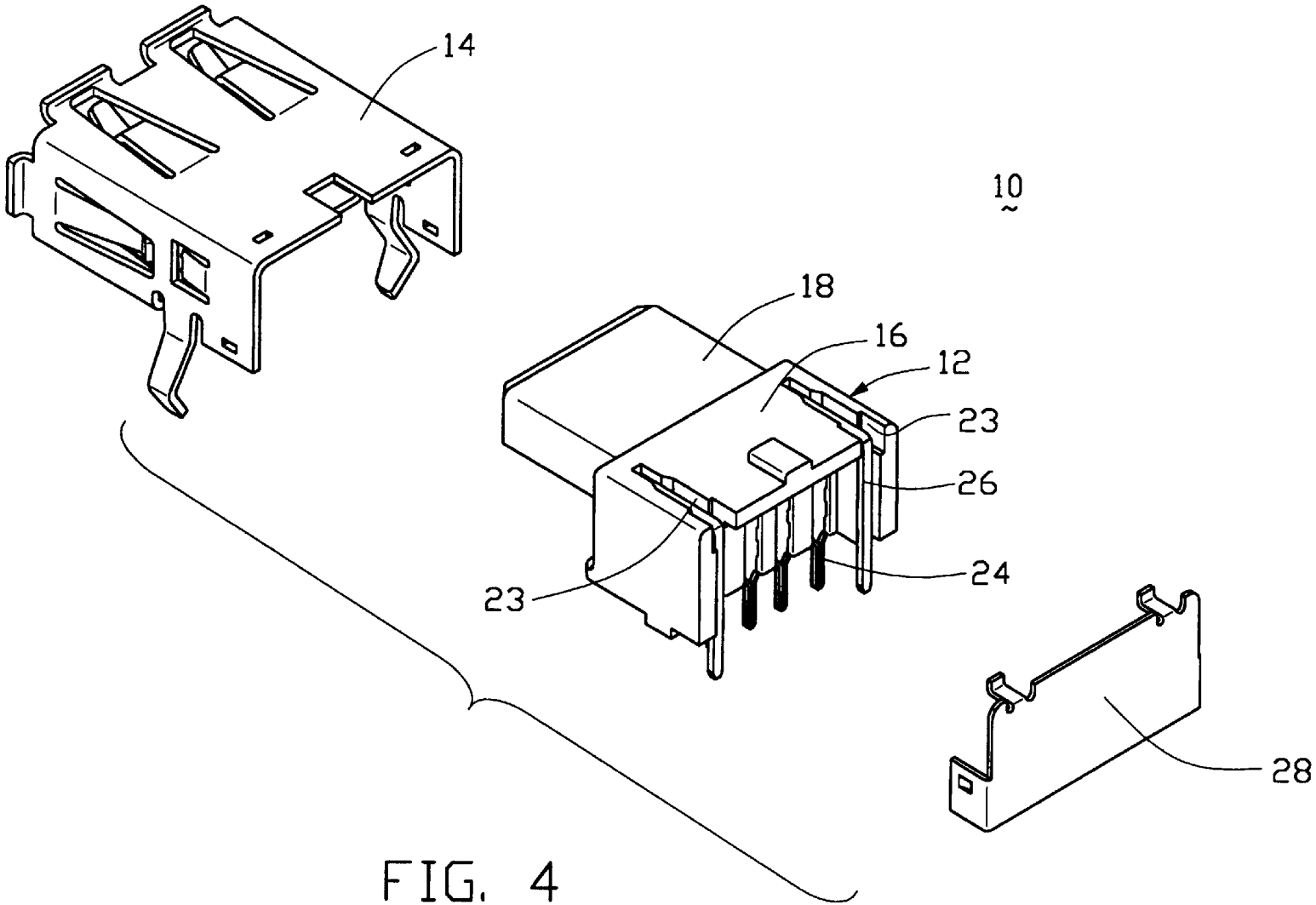
Figure 5:
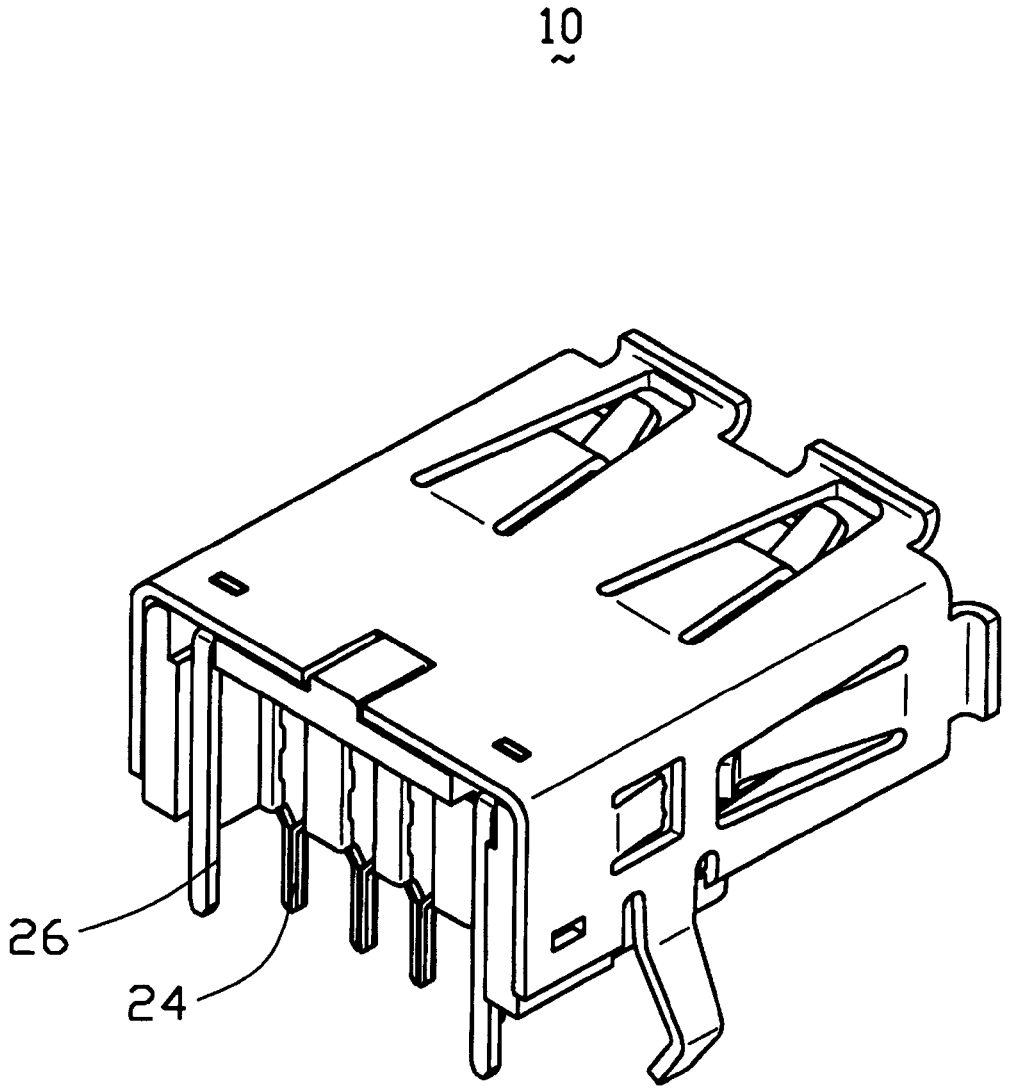
FIGS. 5–7 are perspective view of the assembled receptacle connector of FIG. 1, without showing the back shell, from different angles.
Figure 6:
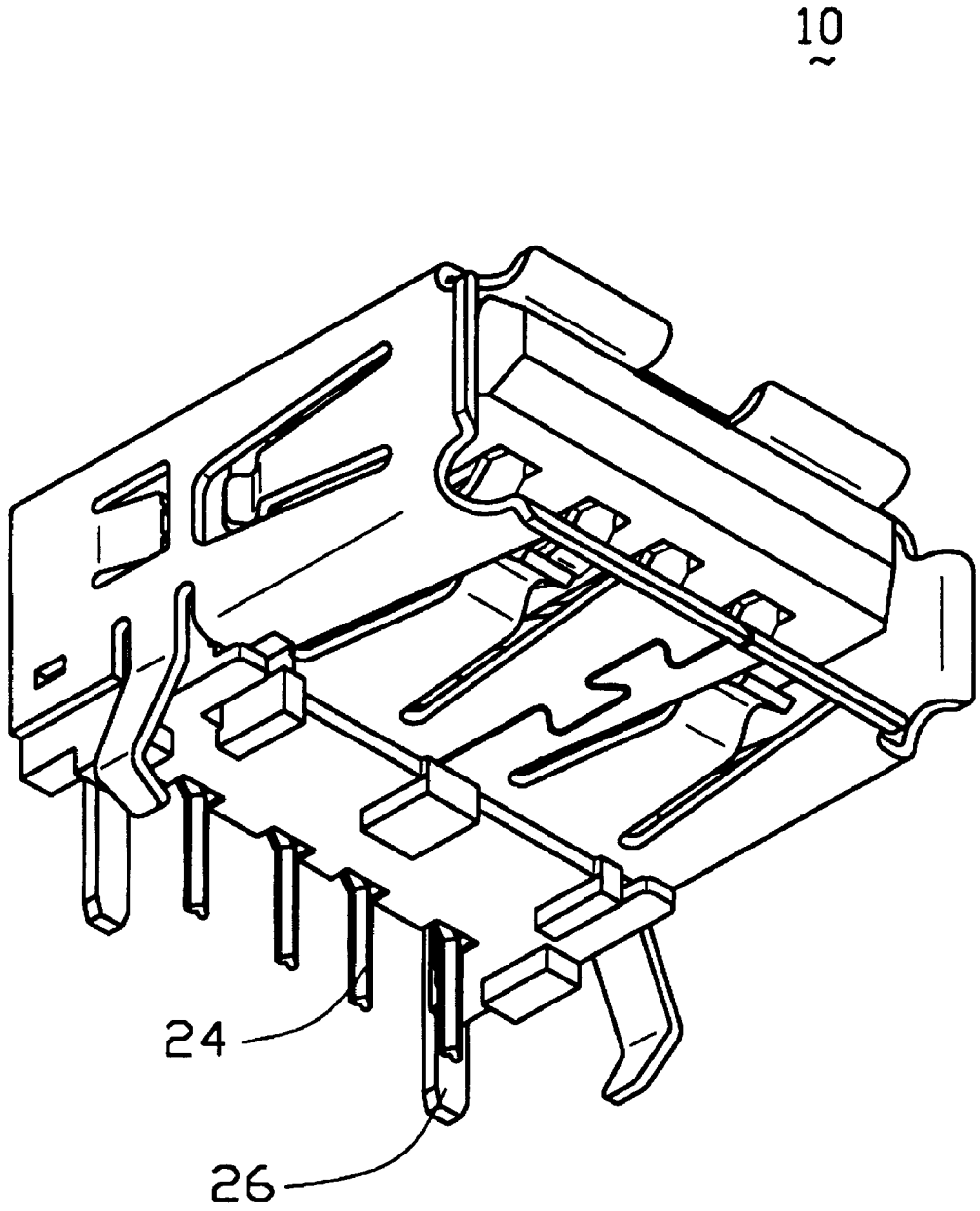
Figure 7:
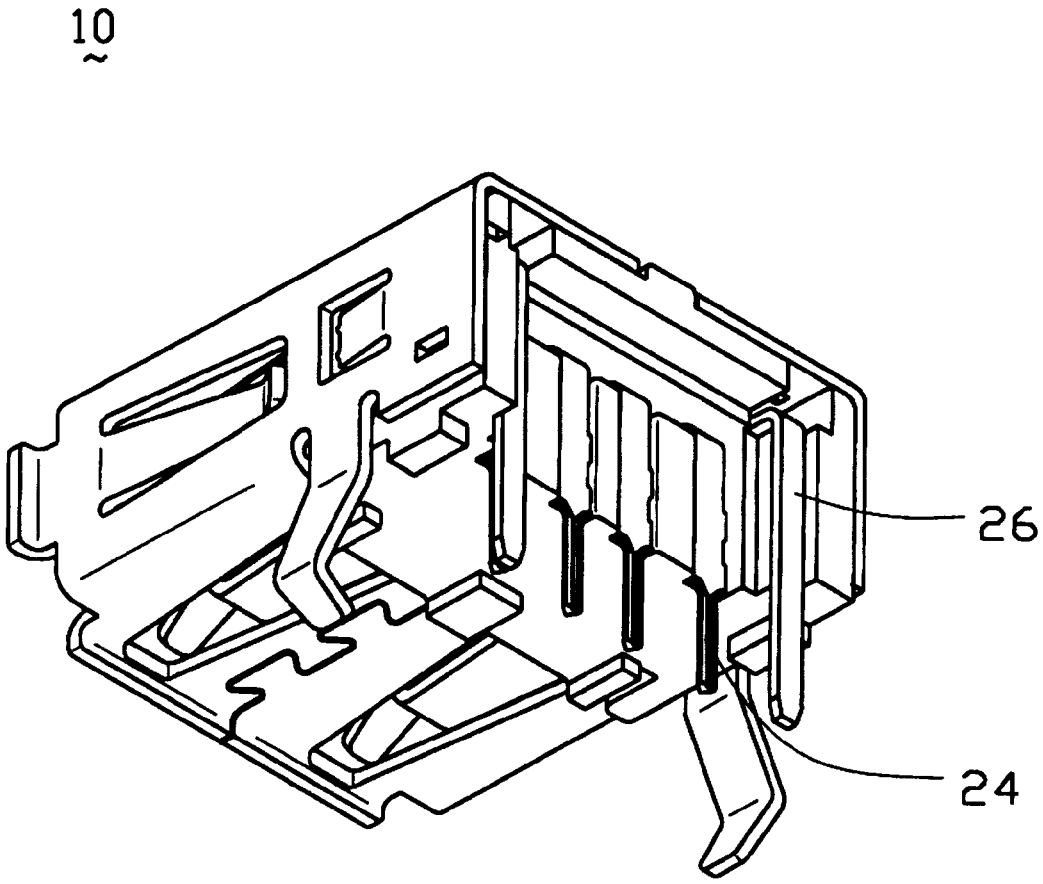

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–7 wherein the receptacle connector 10 includes an insulative housing 12 enclosed within a shell 14. The housing 12 includes a main body 16 with a tongue 18 extending forwardly therefrom. A plurality of passageways 20 are formed in the housing 12, extending along both the main body 16 and the tongue 18 in a front-to-back direction. A pair of channels 22 are formed in the housing by two sides of the passageways 20 in a similar way to the passageways 20. A plurality of signal contacts 24 with retention barbs 25 thereon are retainably received within the corresponding passageways, respectively. A pair of power contacts 26 with retention barbs 21 thereon are respectively retainably disposed in the corresponding channels 22. A back shell 28 is assembled to the shell 14 to cover the rear portion of the housing 12.

Referring to FIGS. 8–11, a plug connector 30 includes an insulative housing 32 enclosed by a shell 34 wherein the housing 32 includes a main body 36 with a contact platform 38 and a solder platform 40 forwardly and rearwardly extending therefrom, respectively. A plurality of passageways 42 are formed in the housing 32, extending along both the main body 36, the contact platform 38 and the solder platform 40 in a front-to-back direction. A pair of channels 44 are formed in the housing 32 by two sides of the passageways 42 in a similar way to the passageways 42. A plurality of signal contacts 46 with retention barbs 45 thereon are retainably received within the corresponding passageways 42, respectively. A pair of power contacts 48 with retention barbs 41 thereon are retainably received within the corresponding channels 44, respectively. It should be understood that FIGS. 8–11 only show the main portion of the plug connector. The other portions of the plug connector, which are not shown in FIGS. 8–11 and not directly related to the subject features, may be referred to U.S. Pat. No. 5,658,170 having the same assignee with the invention.

Figure 12:
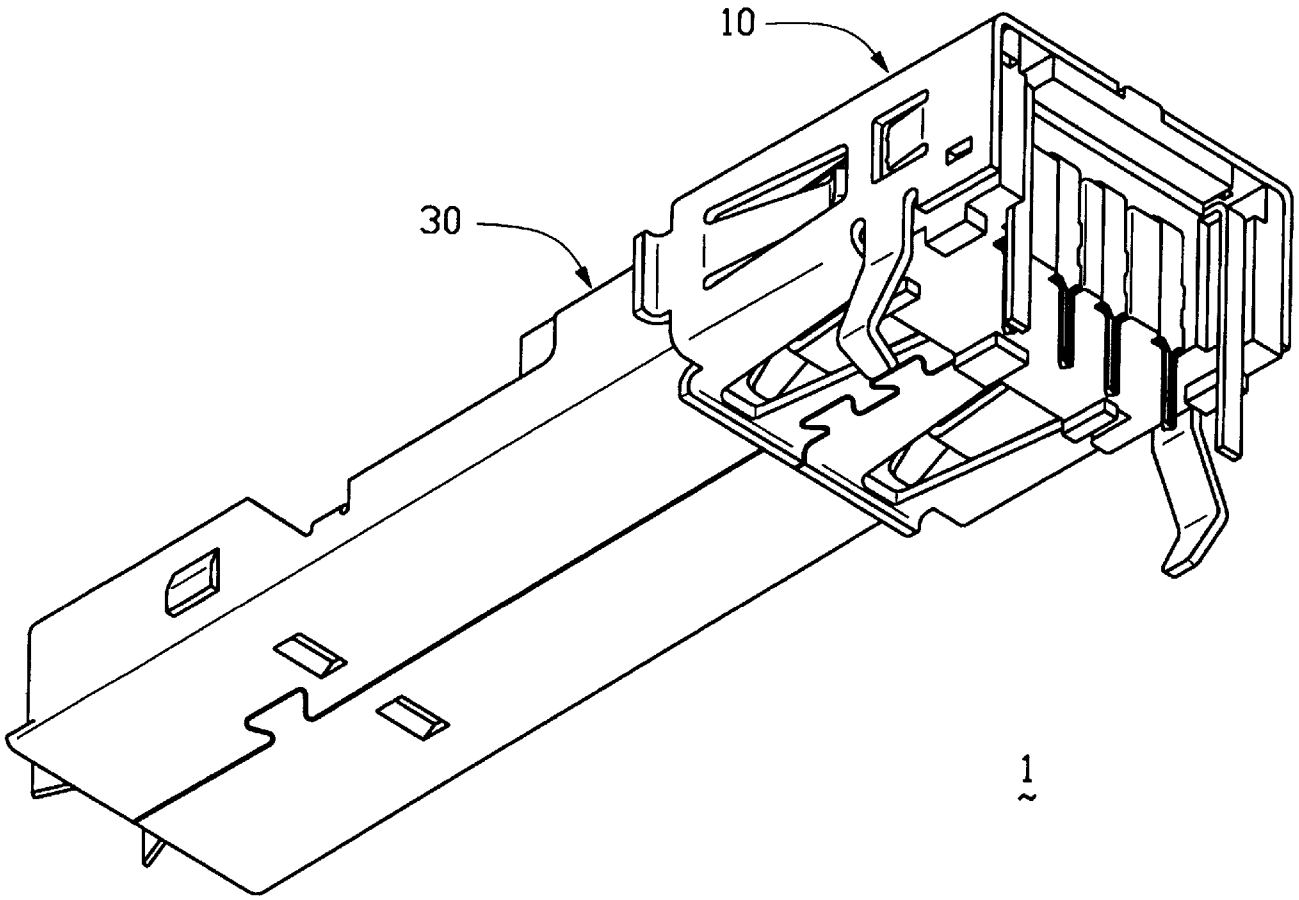
FIGS. 12 and 13 are perspective view of the mated plug connector and receptacle connector from different angles.
Figure 13:
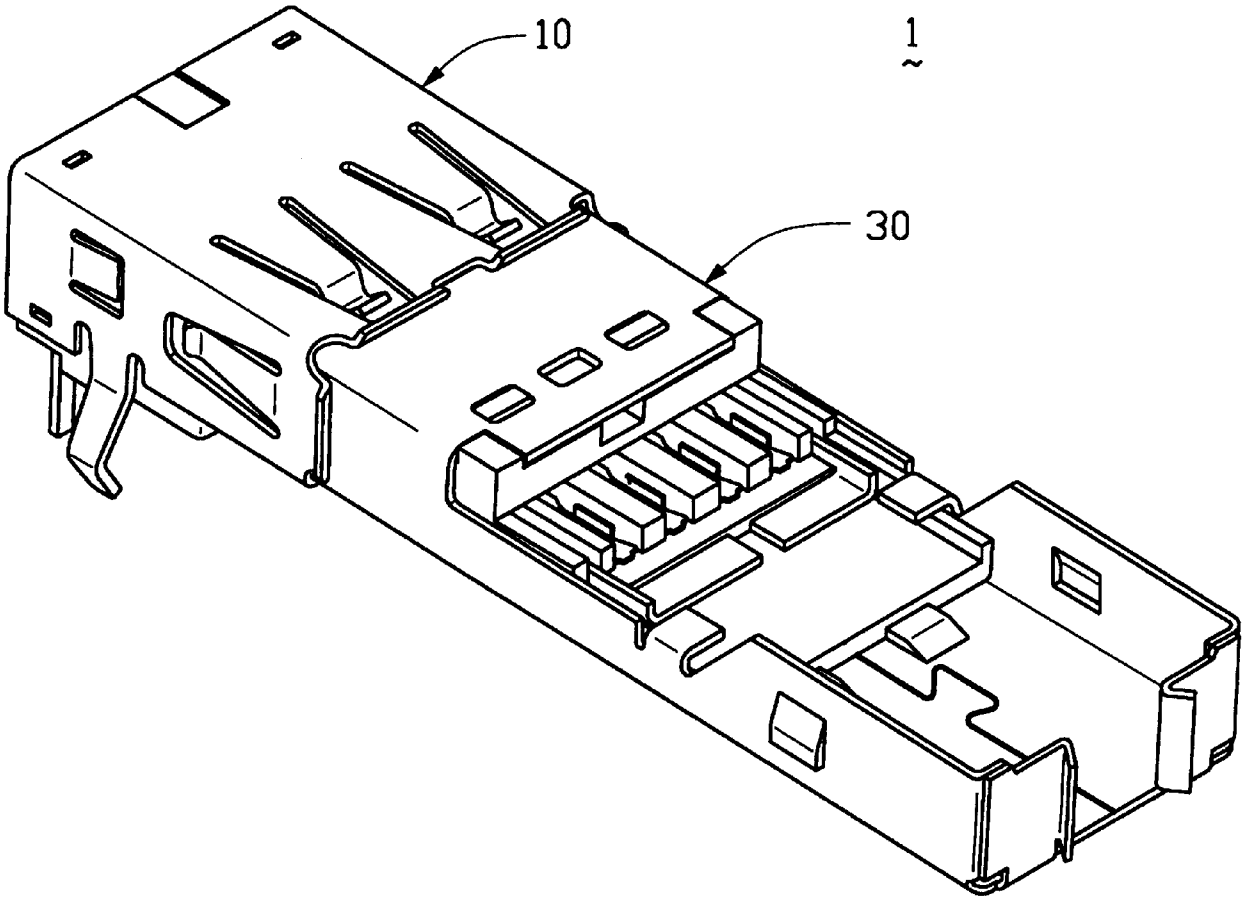
Figure 14:
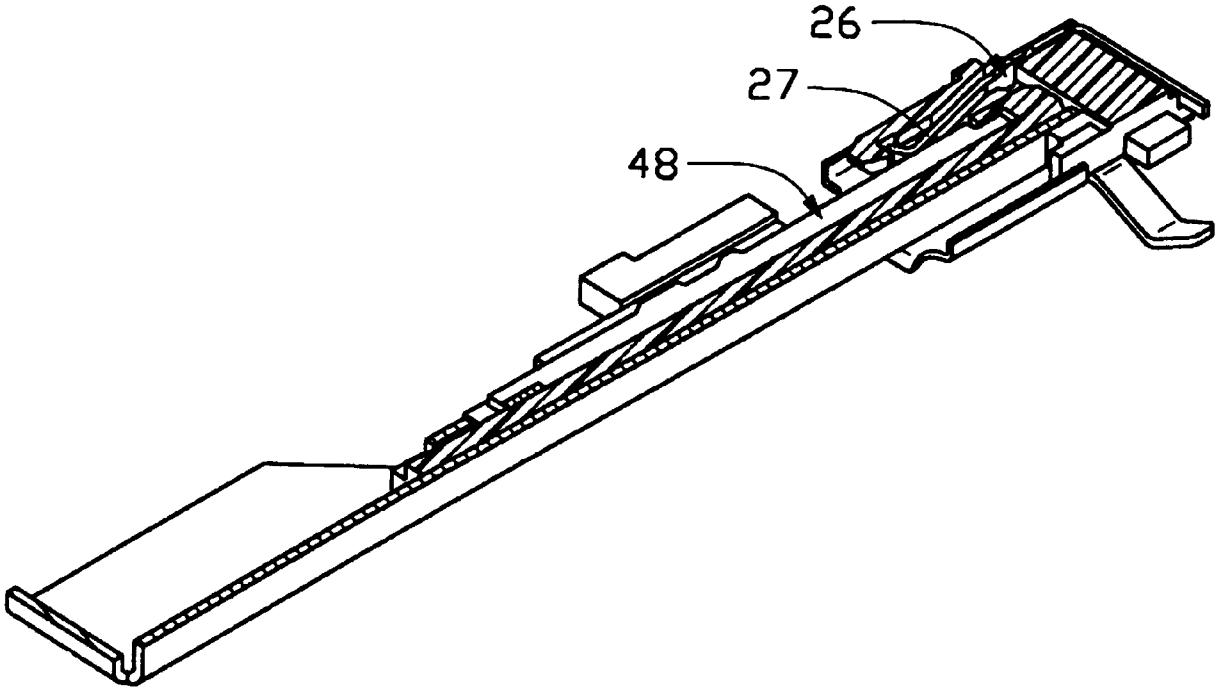
FIG. 14 is a partially cut-away perspective view of the mated plug connector and receptacle connector.
Figure 15A:
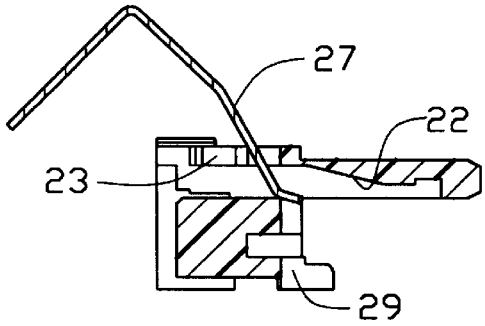
FIGS. 15(A)–15(F) show the procedure of assembling the power contact in the receptacle connector.
Figure 15B:
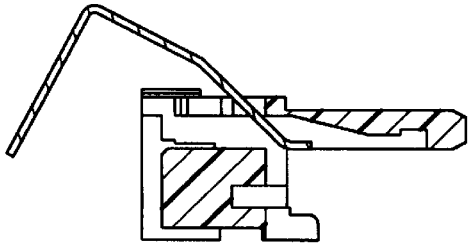
Figure 15C:
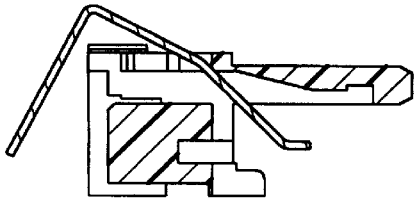
Figure 15D:
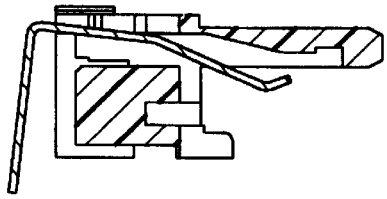
Figure 15E:
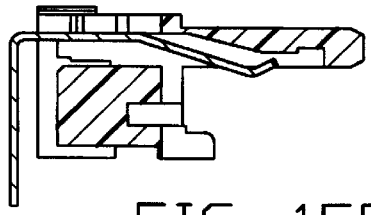
Figure 15F:
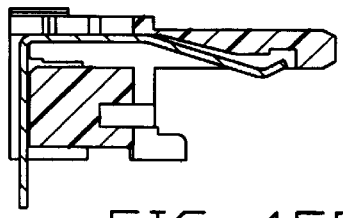

When mated, referring to FIGS. 12–14 showing the connector assembly 1 including the receptacle connector 10 and the plug connector 30, the front portion of the plug connector 30 is inserted into the front portion of the shell 14 of the receptacle connector 10 with the signal contacts 24 of the receptacle connector 10 mechanically and electrically engaging the corresponding aligned signal contacts 46 of the plug connector 30, respectively, and with the power contacts 26 of the receptacle connector 10 mechanically and electrically engaging the corresponding aligned power contacts 48 of the plug connector 30 wherein the signal contacts 24, 46, and the power contacts 26, 48 are arranged in a parallel relationship between.

The features of the invention is to arrange a pair of power contacts in either connector 10, 30 with the same outer profile dimension of the housing and the same spec of the signal contacts including dimensions,spacing, etc., as the original one. Because the limited space is available in either connector 10, 30, the positions, the shapes and the dimensions of the power contacts 24, 48 and the corresponding channels 22, 44 of the receptacle connector 10 and of the plug connector 30 are delicately configured so as to make the whole mated connector assembly perform the desired characters without any interference or jeopardizing of the original signal transmission effect.

Such delicate arrangements are applied to both the receptacle connector 10 and the plug connector 30. For example, the usage of a pair of power contacts 26, 48 in either connector 10, 30, may include the two following reasons. First, there is a limited space between the adjacent signal contacts for installing a power contact, so that each power contact may be of a small size even relative to the signal contact, that does not meet the required large quantity of the power. Thus, doubling the number of the power contact may meet this requirement. Secondly, sometimes the circuit designer may use a pair of contacts to create a loop circuit for some specific purpose, and the invention is competent with this requirement.

Additionally, in this design the pair of power contacts are located by two sides of the signal contact group. It is because the power contacts 24 of the receptacle connector 10 are assembled into the housing 12 in a subtly assembling way with thereof a specific corresponding structures complying therewith. Under this situation, for consideration of the assembling/retention of the power contacts within the housing, the power contacts are desired to be located at two sides of the signal contact group rather than each positioned between two adjacent signal contacts.

Referring to both FIGS. 1, 2, 4 and 15(A)–(F), the channels 22 is narrower (due to the space limitation) than the passageways 20, so that the power contact 26 is narrower than the signal contact 24, while is thicker than the signal contact 24 for compensating the strength thereof. A cutoff 23 is formed above the corresponding channel 22 around the rear portion of the main body 16 so that the power contact 26 can be inserted into the corresponding channel 22 at an initial angle to have the contact portion 27 of the power contact 26 enter the channel 22 via the cutoff 23. The power contact 26 is then rotated to have the whole contact move in a horizontal front-to-back direction and retained in the channel 22. Through this design, the tail portion of the power contact can be located behind and above the tail portion of the signal contacts while without resulting in too large cavity in the housing due to back loading of the power contact and still keeping the sufficient strength of the housing. As well know, the tail portions of both the power and signal contacts are adapted to be mounted to a printed circuit board. It is also noted a pair of notches 29 are formed in the front portion of the main body 16 for tooling consideration of compliance with the aligned channels 22, respectively.

Figure 8:
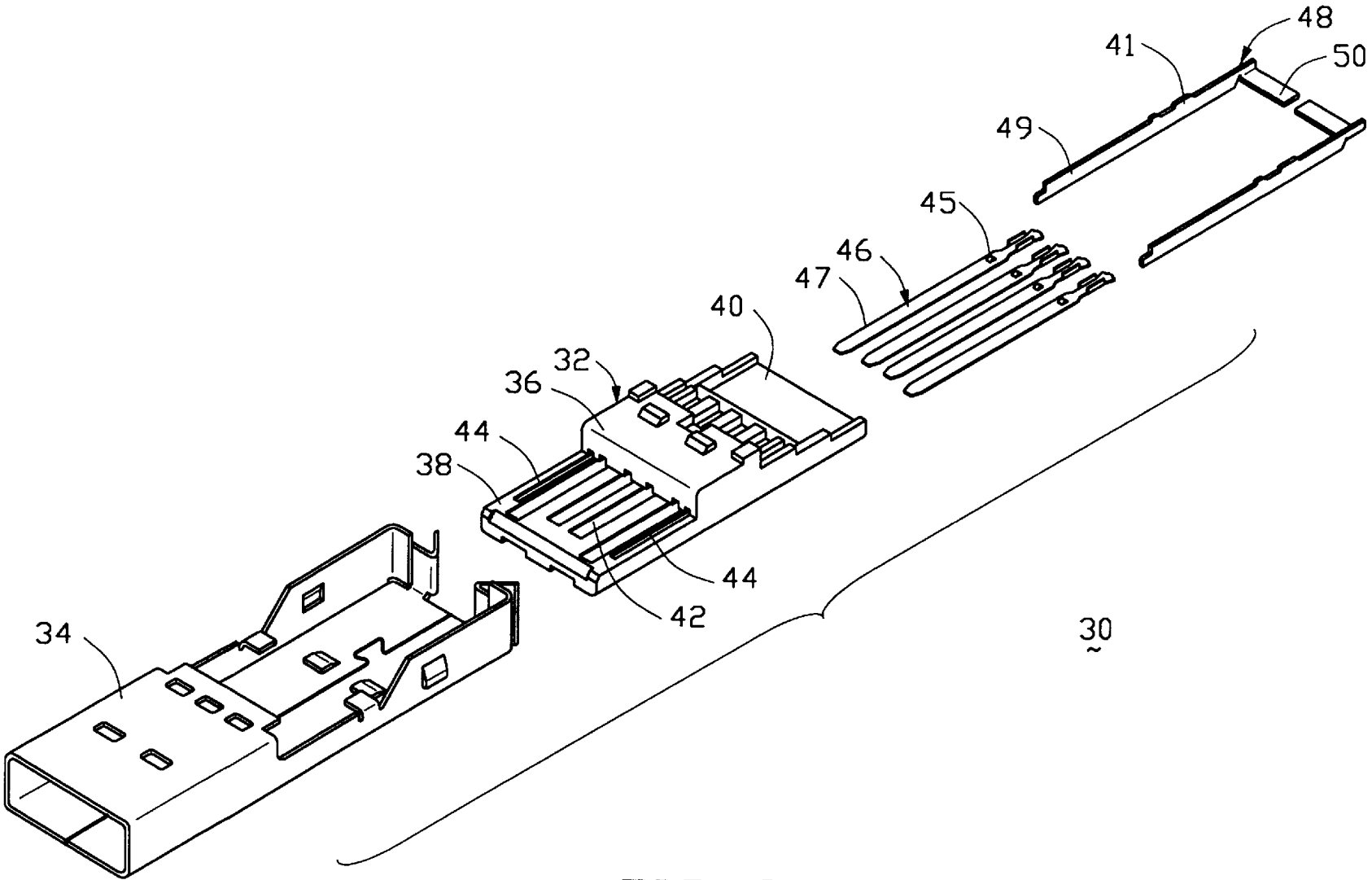
FIG. 8 is an exploded perspective view of a plug connector according to the invention.
Figure 9:
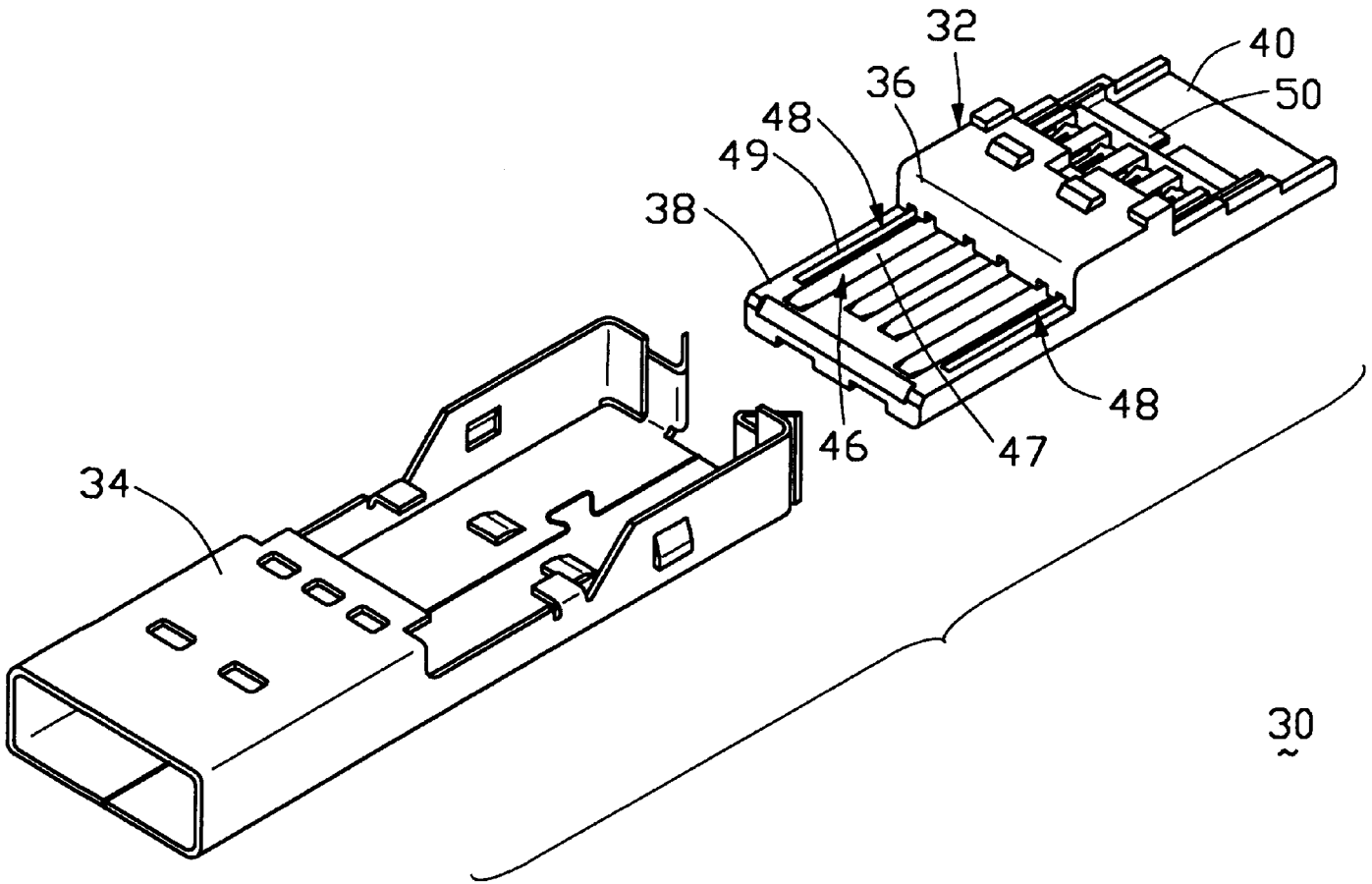
FIG. 9 is an exploded perspective view of partially assembled plug connector of FIG. 8.
Figure 10:
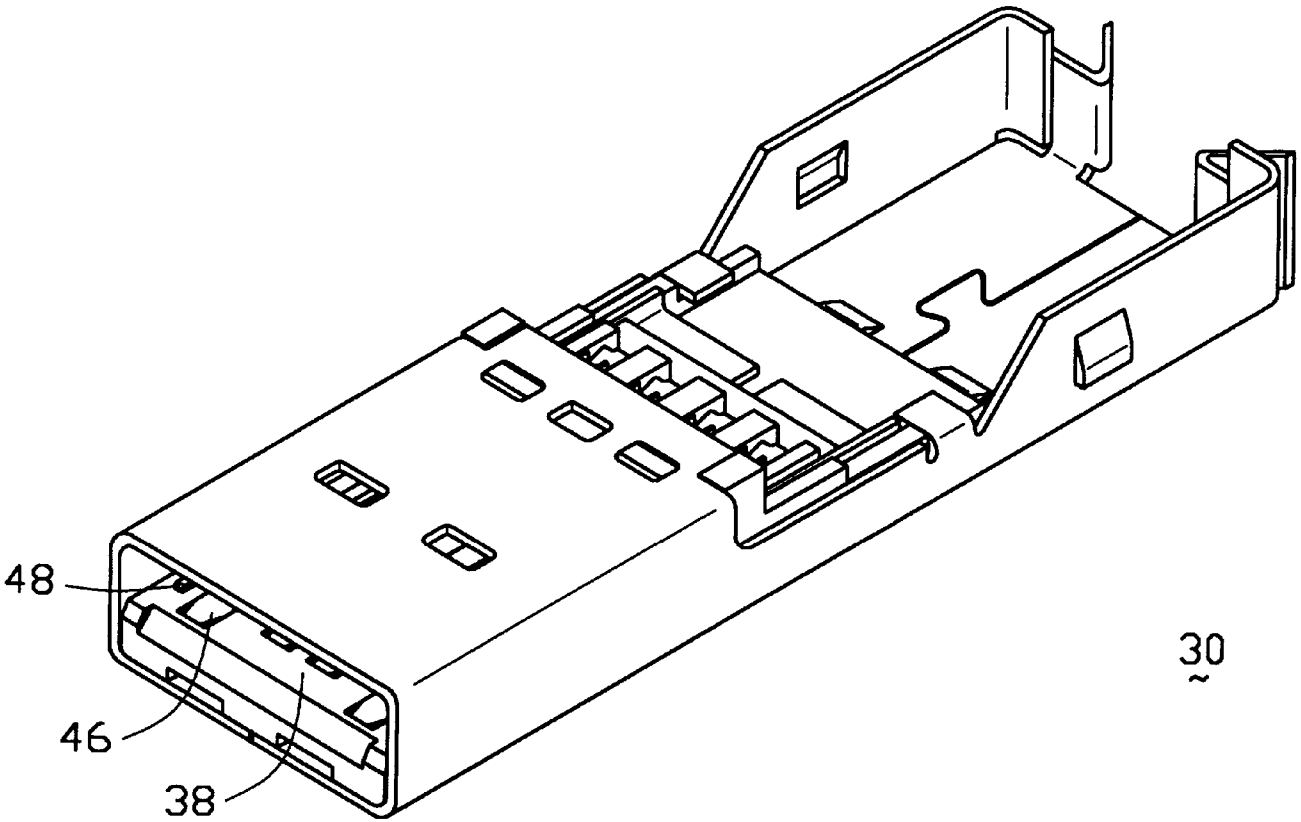
FIGS. 10 and 11 are perspective views of the assembled plug connector of FIG. 8 from different angles.
Figure 11:
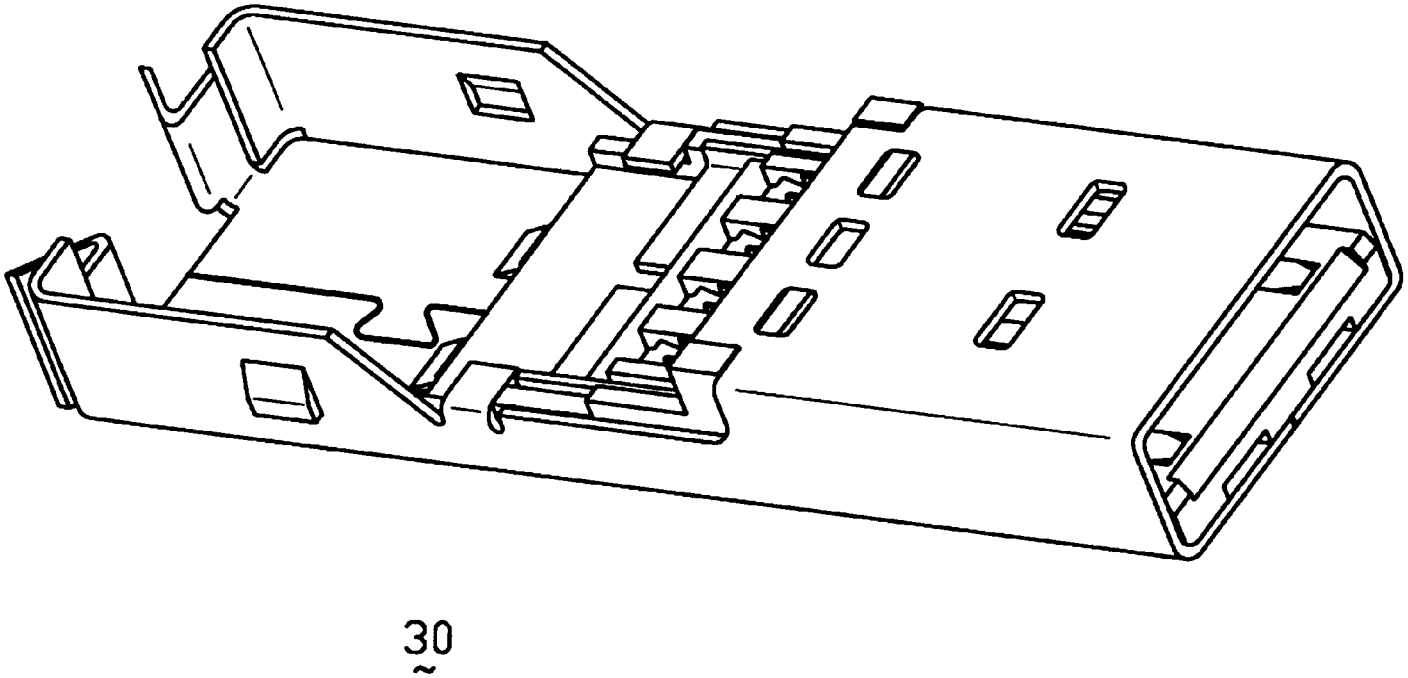

Similarly, referring to FIGS. 8 and 9, the channel 44 is narrower than the passageway 42, so the power contact 48 is narrower than the signal contact 46. To comply with the configuration of the channel 44, the power contact 48 is arranged to have a contact portion 49 located in the contact platform 38 and defining thereof a plane which is perpendicular to another plane defined by the contact portion 47 of the signal contact 46. The power contact 48 further includes a solder portion 50 inwardly horizontally bent/extending around a rear end of the power contact 48, wherein the solder portion 50 defines a plane which is perpendicular to the plane defined by the contact portion 47. The solder portion 50 of the power contact 48 is located behind and below the solder portion of the signal contact 46. As well known, the solder portions of both the power and the signal contacts are located in the solder platform 40 and adapted to be soldered to corresponding wires of the cable assembly, respectively.

It is noted that in this preferred design, in the plug connector 30 the power contacts 48 are little bit higher than the signal contacts 46 in the platform 40 (FIG. 9), and thus corresponding the power contacts 26 are configured to be compliantly little bit recessed than the signal contacts 24 in the receptacle connector 10.

As shown in FIG. 14, in the invention different from the mating between the signal contacts 24, 46 in which the deflectable spring plate engages a stiff plate in a face-to-face or parallel manner, the mating between the power contacts 26, 48 discloses a deflectable spring plate engaging a stiff plate in a face-to-side or perpendicular manner.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included in the scope of the following claims.

We claim:

1. A receptacle connector comprising:

an insulative housing, said housing including a main body with a tongue extending forwardly therefrom;

a plurality of passageways extending in the housing in a front-to-back direction;

a plurality of signal contacts respectively received within the corresponding passageways;

at least one channel disposed in the housing in the front-to-back direction by one side of said passageways; and at least one power contact disposed received within the corresponding channel; wherein said channel is narrower than the passageways, and said power contact is narrower than the signal contacts; wherein each of said signal contacts includes a tail portion and said power contact includes another tail portion, and wherein the tail portion of the power contact extends above and behind that of the signal contact; wherein said housing includes two channels respectively positioned by two sides of the passageways, and there are two power contacts respectively received within said two channels; wherein a pair of cutoffs are formed in a rear portion of the housing in alignment with the corresponding two channels in a vertical direction for allowing initial angular installation and later horizontally assembling of the power contact in the channel.

2. The connector as defined in claim 1, wherein each of said signal contacts includes a contact portion and said power contact includes another contact portion, and wherein the contact portion of the signal contact project beyond that of the power contact in a vertical direction.

3. The connector as defined in claim 1, wherein each of said signal contacts includes a contact portion and said power contact includes another contact portion, and wherein the contact portion of the power contact is thicker than that of the signal contact.

4. A connector assembly comprising:

a receptacle connector and a plug connector, said receptacle connector including:

a first insulative housing, said housing including a first main body with a tongue extending forwardly therefrom;

a plurality of first passageways extending in the housing in a front-to-back direction;

a plurality of first signal contacts respectively received within the corresponding first passageways;

at least one first channel disposed in the housing in the front-to-back direction by one side of said first passageways; and at least one first power contact disposed received within the corresponding first channel; wherein said first channel is narrower than the first passageways, and said first power contact is narrower than the first signal contacts; and said plug connector comprising:

a second insulative housing, said housing including a second main body with a contact platform and a solder platform extending forwardly and rearwardly therefrom, respectively;

a plurality of second passageways extending in the second housing along a front-to-back direction thereof;

a plurality of second signal contacts received within the corresponding second passageways, respectively;

at least one second channel extending in the second housing along said front-to-back direction of the plug connector by one side of said second passageways; and at least one second power contact received within the corresponding second channel; wherein one of the first and second power contacts protrudes beyond the corresponding one of said first and second signal contacts in a vertical direction, while the other of said first and second power contacts protrudes less than the corresponding one of said first and second signal contacts in said vertical direction for compensation consideration of mating of the plug connector and the receptacle connector; wherein the first housing defines a pair of first channels disposed by two sides of the first passageways, and the second housing defines a pair of second channels disposed by two sides of the second passageways; wherein a pair of cutoffs are formed in a rear portion of the first housing in alignment with the corresponding two first channels in a vertical direction for allowing initial angular installation and later horizontally assembling of the first power contact in the first channel.

5. The connector assembly as defined in claim 4, wherein the receptacle connector includes a pair of first power contacts respectively received within the corresponding first channels, and the plug connector includes a pair of second power contacts respectively received within the corresponding second channels.

* * * * *